US007665153B2

(12) United States Patent
Grilliot et al.

(10) Patent No.: US 7,665,153 B2
(45) Date of Patent: Feb. 23, 2010

(54) PROTECTIVE GARMENT EQUIPPED WITH LITTER

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 53 days.

(21) Appl. No.: 11/528,115

(22) Filed: Sep. 27, 2006

(65) Prior Publication Data

US 2008/0072361 A1 Mar. 27, 2008

(51) Int. Cl.
*A41D 13/00* (2006.01)

(52) U.S. Cl. ..... 2/69; 2/94; 182/3

(58) Field of Classification Search ..... 2/102, 2/44, 69, 93, 94, 79, 108, 85, 312; 182/3, 182/4; 244/151 R See application file for complete search history.

(56) References Cited

U.S. PATENT DOCUMENTS 3,973,643 A * 8/1976 Hutchinson ..... 182/3
4,682,671 A 7/1987 Hengstenberger et al.
4,854,418 A 8/1989 Hengstenberger et al.
6,134,713 A * 10/2000 De Rosa et al. ..... 2/94
6,205,584 B1 3/2001 Yocco
6,382,352 B1 * 5/2002 Dowe, Sr. ..... 182/70
6,662,372 B2 * 12/2003 Lewis et al. ..... 2/69
2005/0173188 A1 8/2005 Lewis et al.
2005/0211188 A1 9/2005 Grilliot et al.

* cited by examiner

*Primary Examiner*—Tejash Patel
(74) *Attorney, Agent, or Firm*—Wood, Phillips, Katz, Clark & Mortimer

(57) ABSTRACT

A protective garment for a firefighter or for an emergency rescue worker is equipped with a drag harness and with a litter, which, when not deployed, is stored within a pocket of the garment and wherein the drag harness and the litter, when deployed, facilitate carrying a wearer. A back-covering portion of the protective garment has the pocket, which is located where the back-covering portion covers a lower region of the back of a wearer. The drag harness has two arm loops and a drag grip, which is attached to the arm loops and which extends outwardly through apertures in an upper region of the back-covering portion. The litter has two, flexible, longitudinal members, each of which is attached to one of the arm loops of the drag harness, and multiple, flexible, transverse members, which extend between the longitudinal members, outside the pocket, when the litter is deployed.

2 Claims, 2 Drawing Sheets

PROTECTIVE GARMENT EQUIPPED WITH LITTER

TECHNICAL FIELD OF THE INVENTION

This invention pertains to a protective garment, such as a protective coat or protective coveralls, for a firefighter or for an emergency rescue worker. This invention provides that the protective garment is equipped with a litter, which, when not deployed, is adapted to be stored within the protective and which, when deployed, is adapted to facilitate carrying a wearer of the protective garment, so equipped.

BACKGROUND OF THE INVENTION

Commonly, a firefighter or an emergency rescue worker who wears a protective garment, such as a protective coat, protective coveralls, or protective overalls, also wears a drag harness, which is a harness used by a rescuer to drag a stricken wearer from a perilous situation. Such a harness may be also called a drag rescue device.

Commonly, as worn with a protective garment, such as a protective coat or protective coveralls, a drag harness has two arm loops, each of which is adapted to receive one of the arms of a wearer, and a drag grip, which extends outwardly through an aperture or apertures in an upper region of a back-covering portion of the protective garment.

Drag harnesses, as discussed in the preceding paragraphs, are exemplified in U.S. Pat. Nos. 4,682,671, 4,854,418, and 6,205,584 B1, and in United States Patent Application Publications No. US 2005/0173188 A1 and No. US 2005/0211188 A1.

SUMMARY OF THE INVENTION

This invention provides, for a firefighter or for an emergency rescuer worker, a protective garment, which is equipped with a litter. When not deployed, the litter is adapted to be stored within the garment. When deployed, the litter is adapted to facilitate carrying a wearer of the protective garment. Preferably, the litter has two, flexible, longitudinal members and multiple, flexible, transverse members, which extend between the longitudinal members, outside the protective garment, when the litter is deployed.

Preferably, the protective garment has a back-covering portion, which is adapted to cover the back of a wearer, and the back-covering portion has a pocket, in which the litter, when not deployed, is adapted to be stored and which is located where the back-covering portion is adapted to cover a lower region of the back of the wearer. Preferably, the litter has two, flexible, longitudinal members and multiple, flexible, transverse members, which extend between the longitudinal members, outside the protective garment and outside the pocket, when the litter is deployed.

Preferably, the protective garment is equipped with a drag harness and with a litter, as described above. Preferably, moreover, the drag harness has two arm loops, each of which is adapted to receive one of the arms of a wearer. Preferably, moreover, the litter has two, flexible, longitudinal members, each of which is attached to one of the arm loops of the drag harness, and multiple, flexible, transverse members, which, when the litter is deployed, extend between the longitudinal members, outside the protective garment and, if the pocket described above is provided, outside the pocket.

Herein, directional terms, such as upper, lower, side, and back, are taken from a standpoint of an erectly standing wearer of the protective garment.

DETAILED DESCRIPTION OF THE ILLUSTRATED EMBODIMENT

Figure 1:
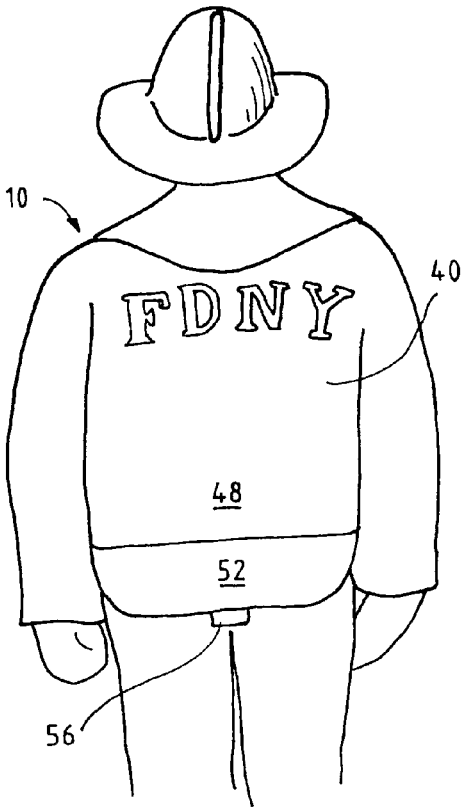
FIG. 1 is a pictorial, back view of a protective garment, which is equipped with a drag harness and with a litter, so as to embody this invention.
Figure 2:
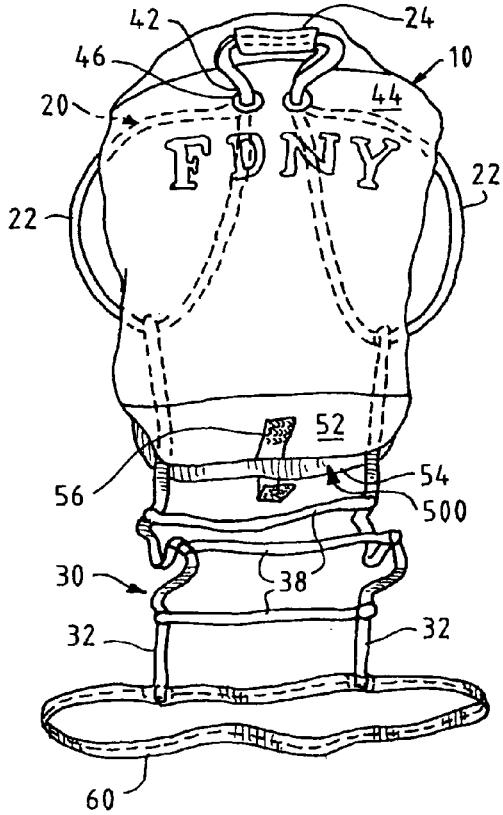
FIG. 2 is a partly fragmentary, pictorial, back view of the protective garment, as illustrated with a collar lifted so as to expose a drag grip of the drag harness and with a pocket opened so as to deploy the litter.
Figure 3:
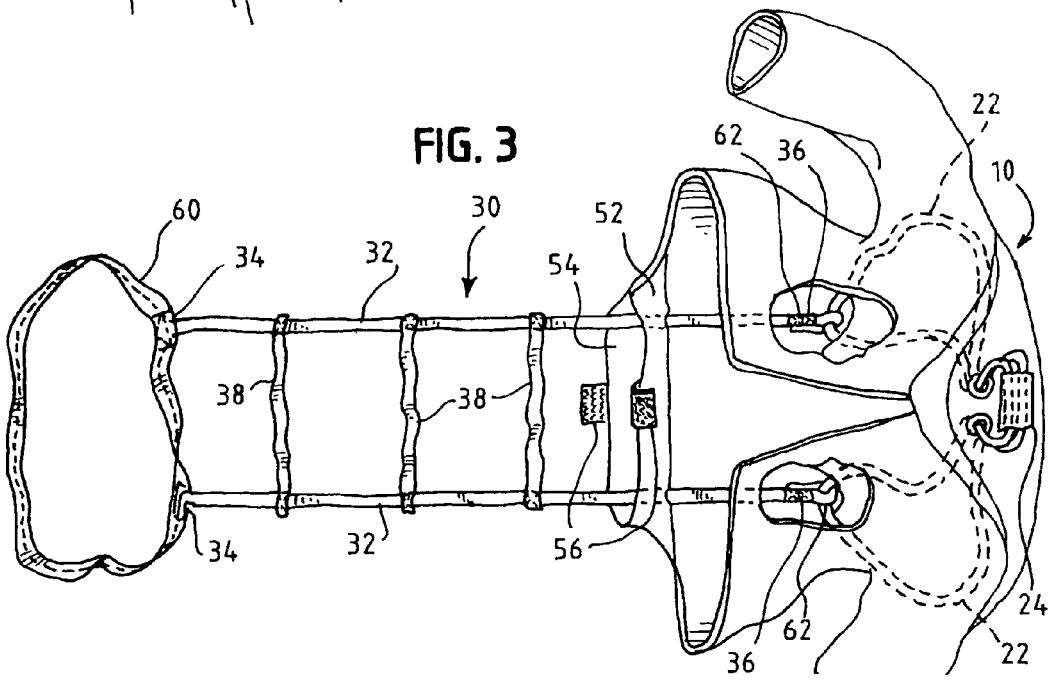
FIG. 3 is a pictorial layout of the drag harness and the litter, with the protective coat illustrated fragmentarily.

As illustrated in FIG. 1 and other views, a protective coat 10 worn by a firefighter is equipped with a drag harness 20 and with a litter 30, so as to embody this invention. The drag harness 20 and the litter 30, when deployed, facilitate carrying the firefighter wearing the protective coat 10, so equipped.

The drag harness 20 may conform to one of the drag harnesses disclosed in United States Patent Application Publications No. US 2005/0173188 A1 and No. US 2005/0211188 A1, the disclosures of which are incorporated by reference herein. The drag harness 20 has two arm loops 22, each of which is covered by the protective coat when the protective coat 10 and the drag harness 20 are worn by the firefighter and each of which is adapted to receive one of the arms of the firefighter wearing the protective coat 10 and the drag harness 20.

The drag harness 20 has a drag grip 24, which is accessible at a back-covering portion 40 of the protective coat 10, through two apertures 42 in an upper region 44 of the back-covering portion 40 of the protective coat 10. Each aperture 12 is defined by a grommet 46. In other respects, the drag harness 20 may conform to one of the drag harnesses disclosed in United States Patent Application Publications No. US 2005/0173188 A1 and No. 2005/0211188 A1, the disclosures of which are incorporated by reference herein.

The back-covering portion 40 of the protective coat 10 has a pocket 50, in which the litter 20, when not deployed, is adapted to be stored. The pocket 50 is located at a lower region 48 of the back-covering portion 40, where the back-covering portion 40 covers a lower region of the back of the firefighter wearing the protective coat 10. The back-covering portion 40 of the protective coat 10 has two flaps 52, 54, which can be separated to open the pocket 50 and which can be drawn together to close the pocket 50, and has a hook-and-loop closure 56, which can be used to attach the flaps 52, 54, to each other when the flaps 52, 54, are drawn together to close the pocket 50.

The litter 30 has two, flexible, longitudinal members 32, which are made from strapping, as illustrated, or from rope and which have distal ends 34 and proximal ends 36. The litter 30 has multiple, flexible, transverse members 38, which are made from strapping, as illustrated, or from rope, and which extend between the longitudinal members 32, outside the protective garment 10 and outside the pocket 50, when the litter 30 is deployed. The litter 30 has a gripping loop 60, which is made from strapping, as illustrated, or from rope, and which is attached to the distal ends 34 of the longitudinal members 32, such that the gripping loop 60 is outside the protective garment 10 and outside the pocket 50, when the litter 30 is deployed. The proximal end 36 of each of the longitudinal members 32 is attached, at a juncture 62, to one of the arm loops 22 of the drag harness 20, whereby the drag harness 20 and the litter 30 are unitized.

Figure 4:
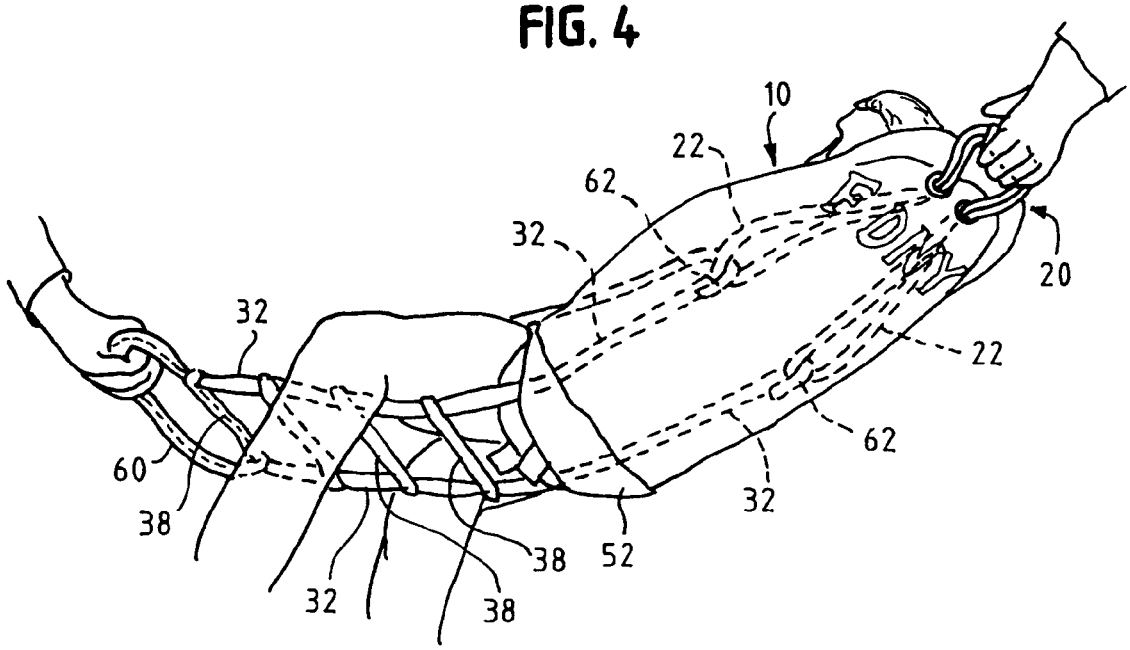
FIGS. 4 and 5 are pictorial, side views of a firefighter being carried by rescuers, via a drag harness and a litter, with the firefighter positioned differently in each side view.
Figure 5:
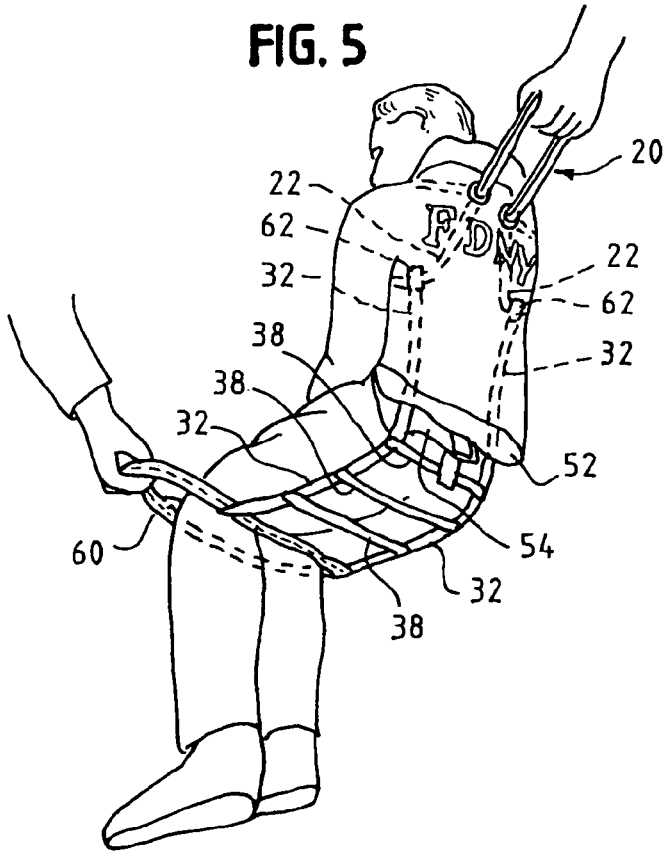

So unitized, the drag harness 20 and the litter 30, when deployed, facilitate carrying the firefighter wearing the protective coat 10, by one rescuer grasping the drag grip 24 of the drag harness 20 and by another rescuer grasping the gripping loop 60 of the litter. The firefighter being carried can drape his or her legs over the longitudinal members 32, as illustrated in FIG. 4, or can drape his or her legs through the gripping loop 60, as illustrated in FIG. 5.

The invention claimed is:

1. For a firefighter or for an emergency rescue worker, a protective garment, which is equipped with a litter, wherein the litter, when not deployed, is adapted to be stored within the garment and wherein the litter, when deployed, is adapted to facilitate carrying a wearer of the protective garment, so equipped; the litter having two, flexible, longitudinal members and multiple, flexible, transverse members, which, when the litter is deployed, extend between the longitudinal members, outside the protective garment.

2. For a firefighter or for an emergency rescue worker, a protective garment, which is equipped with a litter, wherein the litter, when not deployed, is adapted to be stored within the garment and wherein the litter, when deployed, is adapted to facilitate carrying a wearer of the protective garment, so equipped; the protective garment having a back-covering portion, which is adapted to cover the back of a wearer, wherein the back-covering portion has a pocket, in which the litter, when not deployed, is adapted to be stored and which is located where the back-covering portion is adapted to cover a lower region of the back of the wearer; and wherein the litter has two, flexible, longitudinal members and multiple, flexible, transverse members, which extend between the longitudinal members, outside the protective garment and outside the pocket, when the litter is deployed.

* * * * *

UNITED STATES PATENT AND TRADEMARK OFFICE

CERTIFICATE OF CORRECTION

PATENT NO. : 7,665,153 B2
APPLICATION NO. : 11/528115
DATED : February 23, 2010
INVENTOR(S) : Grilliot et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 91 days.

Signed and Sealed this

Seventh Day of December, 2010

David J. Kappos

David J. Kappos
*Director of the United States Patent and Trademark Office*